United States Patent [19]

Stubblefield

[11] Patent Number: 4,741,114

[45] Date of Patent: May 3, 1988

[54] SHOE SOLE CONSTRUCTION

[75] Inventor: Jerry D. Stubblefield, Portland, Oreg.

[73] Assignee: AVIA Group International, Inc., Portland, Oreg.

[21] Appl. No.: 65,682

[22] Filed: Jun. 22, 1987

Related U.S. Application Data

[60] Continuation of Ser. No. 899,057, Aug. 22, 1986, abandoned, which is a division of Ser. No. 792,005, Oct. 28, 1985, abandoned, which is a continuation of Ser. No. 751,127, Jul. 2, 1985, abandoned, which is a continuation of Ser. No. 602,261, Apr. 20, 1984, abandoned, which is a continuation of Ser. No. 571,645, Jan. 18, 1984, abandoned, which is a continuation of Ser. No. 464,313, Feb. 7, 1983, abandoned, which is a division of Ser. No. 185,957, Sep. 10, 1980, Pat. No. 4,372,058, which is a continuation of Ser. No. 935,584, Aug. 21, 1978, abandoned, which is a continuation-in-part of Ser. No. 853,482, Nov. 21, 1977, abandoned.

[51] Int. Cl.[4] ..... A43B 13/04; A43B 13/18; A43B 13/26; A43B 5/00

[52] U.S. Cl. ..... 36/32 R; 36/30 R; 36/59 C; 36/114; 36/129; D2/320

[58] Field of Search ..... 36/32 R, 59 R, 59 C, 36/30 R, 25 R, 114, 128, 129, 67 A; D2/319, 320, 321, 322

[56] References Cited

U.S. PATENT DOCUMENTS

| | | | |
|---|---|---|---|
| 3,100,354 | 8/1963 | Lombard et al. | 36/32 R |
| 3,290,801 | 12/1966 | Bente | 36/129 |
| 4,043,058 | 8/1977 | Hollister et al. | 36/67 A |

FOREIGN PATENT DOCUMENTS

| | | | |
|---|---|---|---|
| 221265 | 3/1959 | Australia | 36/32 R |
| 968597 | 3/1958 | Fed. Rep. of Germany | 36/32 R |
| 255084 | 1/1949 | Switzerland | 36/32 R |
| 328731 | 5/1958 | Switzerland | 36/32 R |

*Primary Examiner*—James Kee Chi

*Attorney, Agent, or Firm*—Saidman, Sterne, Kessler & Goldstein

[57] ABSTRACT

A shoe sole including an outer sole of substantially uniform thickness and a midsole. The midsole has peripheral portions that are relatively thick compared to its central portion which is relatively thin. The lower surface of the midsole is preferably configured as a concavity. The outer sole has a top surface which is connected to the concave lower surface of the midsole to define, along with the midsole, a general lateral concavity for the shoe. The lower surface of the outer sole includes tread members. The outermost tread members, outer sole and midsole cooperate to support the relatively thin central portion of the midsole in a cantilever fashion. Upon ground impact, the lower extremities of the tread members are urged resiliently upwardly and outwardly, and the relatively thin central portion flexes downwardly to provide cushioning for the foot of the wearer.

15 Claims, 2 Drawing Sheets

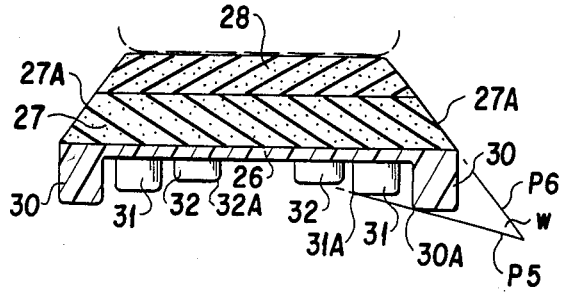
FIG. 7
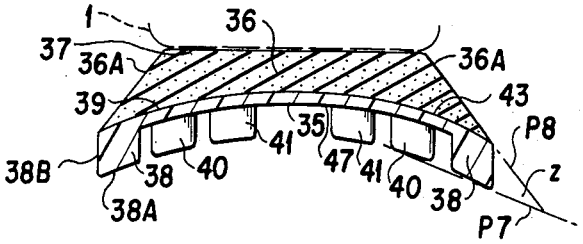
FIG. 8
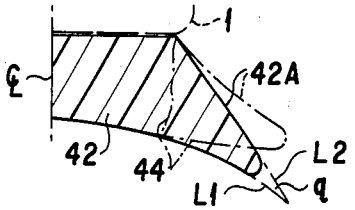
FIG. 9
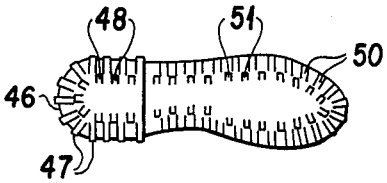
FIG. 10
FIG. 11
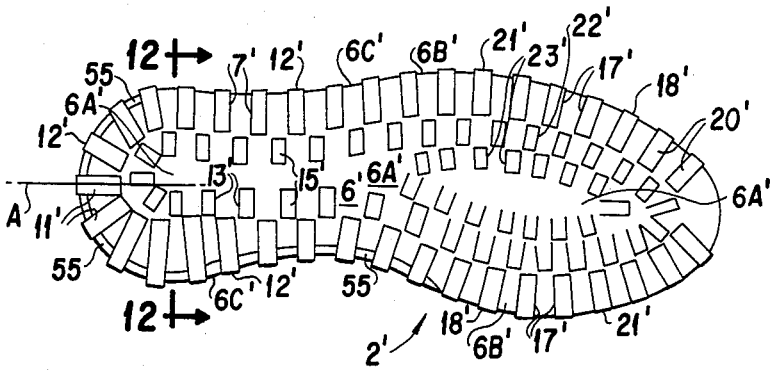
FIG. 12
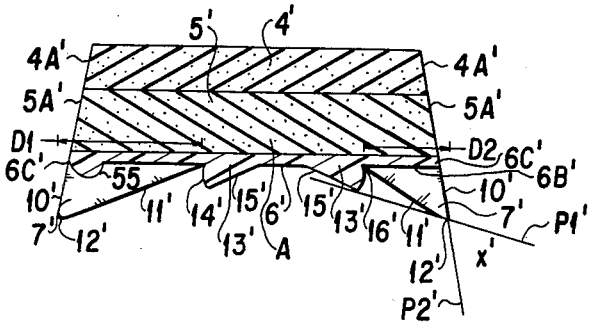

SHOE SOLE CONSTRUCTION

CROSS REFERENCE TO RELATED APPLICATIONS

This application is a continuation of application Ser. No. 899,057, filed Aug. 22, 1986 now abandoned, which is a division of Ser. No. 792,005, filed Oct. 28, 1985, now abandoned, which is a continuation of Ser. No. 751,127 filed July 2, 1985 and now abandoned, which is a continuation of Ser. No. 602,261, filed Apr. 20, 1984, and now abandoned, which is a continuation of Ser. No. 571,645, filed Jan. 18, 1984 and now abandoned, which is a continuation of Ser. No. 464,313 filed Feb. 7, 1983 and now abandoned, which is a division of Ser. No. 185,957 filed Sept. 10, 1980, now U.S. Pat. No. 4,372,058 issued Feb. 8, 1983, which is a continuation of Ser. No. 935,584 filed Aug. 21, 1978 and now abandoned, which is a continuation-in-part of Ser. No. 853,482 filed Nov. 21, 1977 and now abandoned.

BACKGROUND OF THE INVENTION

The present invention relates generally to shoes and specifically to shoe sole construction. The increased popularity of competitive and recreational running, witnessed in the last few years, has resulted in the introduction of a wide variety of athletic shoe designs wherein shoe upper and sole constructions have embodied changes directed toward specific objectives. For example, in the prior art is shoe sole construction having "flared" side edges extending continuously about the heel portion ostensibly for supplementing heel stability, and sole constructions with tread designs directed toward minimizing impact loads on the foot and leg.

To the extent the prior art is known, efforts have been made to provide soles for athletic shoes with the sole having cupped tread surfaces with the outer tread surfaces being continuous in order to affect a momentary seal between the sole and floor for traction purposes. Examples of such efforts are found in indoor type athletic shoes in U.S. Pat. Nos. 1,962,526 and 2,071,431. Neither of the foregoing patents disclose multiple lug series in proximity of both sole edges. Additionally, U.S. Pat. No. 3,100,354 discloses a shoe sole having a lengthwise orientated concavity but significantly different from the present invention in that the concavity is laterally defined by the flat sole surfaces of considerable width, and in similarity to the first mentioned patents does not utilize laterally spaced series of tread components with each series of an effective different height. U.S. Pat. No. 4,085,527 shows intermingled cleats.

SUMMARY OF THE PRESENT INVENTION

The present invention is embodied in sole construction wherein sole components are intended to provide among other objectives, desired cushioning of the wearer's foot and leg regardless of the surface run on to reduce impact loads and the chance of foot or leg injuries to the wearer.

The present sole construction benefits from a lengthwise oriented concave shape extending along the shoe sole with the composite surfaces of the sole tread defining the concavity. The lower extremities of the tread are adapted to flex upwardly and outwardly relative to the shoe upper upon ground contact. Accordingly a central portion of the outer sole directly below the foot is supported in cantilever fashion by the tread and resiliently cushions the foot as the shoe comes into maximum ground contact. As greater impact loads are encountered by the heel portion of the shoe, this feature is particularly important when embodied within the heel. The forward portion of the sole underlying the forefoot and ball of the foot, while not subjected to as great impact forces, does bear greater overall loads during running, which loads are resiliently supported by the forward tread portion of the present sole while importantly providing the sole flexibility desired.

While the present invention is shown and described in conjunction with an athletic shoe, such is not intended to imply limited use of same but rather the present sole construction may be further utilized in other footwear as later elaborated upon.

Important objectives of the present invention include: the provision of a sole the tread of which defines a lengthwise oriented concavity which concavity also extends laterally to the sole edges; the provision of a sole wherein the outer series of lugs are inclined downwardly and outwardly to provide a highly resilient tread adapted to flex upwardly, and in some instances outwardly, relative to the shoe upper during ground contact to thereby cushion the foot; the provision of a shoe sole permitting uneven compression of sole lugs during asymmetrical loading during execution of a turn by a runner; the provision of a sole having a high degree of stability even on uneven ground surfaces or surfaces having loose gravel or other obstructions thereon; the provision of shoe sole construction having inner and outer series of lugs with some of the lugs of the outer series interconnected by a web to reinforce the joined lugs against load deflection to reduce ankle pronation; the provision of shoe sole construction wherein the lugs of an outer series located along the sole margin are of non-uniform length to better accommodate loads applied thereto without severe distortion to inhibit ankle pronation; the provision of shoe sole construction having an inner and an outer series of lugs with the inner series of lugs disposed asymmetrically of a sole major axis.

BRIEF DESCRIPTION OF THE DRAWING

In the accompanying drawing:

FIG. 7 is a sectional view of a modified sole construction;

FIG. 8 is another sectional view of a futher form of modified shoe sole construction;

FIG. 9 is a sectional view of still another form of modified sole construction;

FIG. 10 is a plan view of a distinct shoe sole and heel embodying the present invention;

FIG. 11 is a bottom plan view of shoe sole construction embodying the present invention; and FIG. 12 is a sectional view taken along line 12—12 of FIG. 11 rotated through ninety degrees.

DETAILED DESCRIPTION OF THE PREFERRED EMBODIMENT

Figure 1:
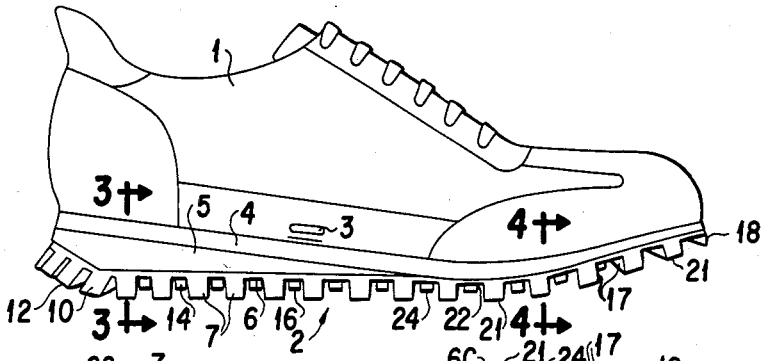
FIG. 1 is a side elevational view of a shoe embodying the present sole improvements.

With continuing attention to the drawing, the reference numeral 1 indicates the upper of an athletic shoe customarily fabricated from stitched fabric or leather pieces. The particular construction of the upper is not part of the present invention and, accordingly, further details of same are superfluous.

Figure 3:
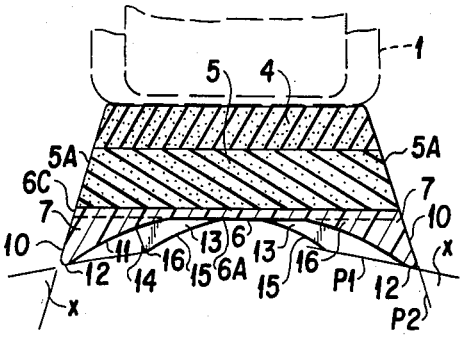
FIGS. 3 and 4 are sectional views taken along lines 3—3 and 4—4 of FIG. 1 showing the transverse configurations of heel and forefoot sole portions.

The present sole construction is indicated generally at 2 and includes a tread or that portion of the sole coming into ground contact. Customarily, athletic shoes of the type shown have soles including an insiole 3, a resilient mid-sole 4, a resilient heel wedge 5 and an outer sole 6 defined by a lower surface generally having a central portion 6A, a peripheral portion 6B and an outer edge 6C. The upper 1 and mid-sole 4 are typically bonded to one another by an adhesive, as is the outer sole 6 to the mid-sole 4 and heel wedge. Midsole 4 and heel wedge 5 together may be said to constitute an "intermediate section" which, at least in the heel portion of the shoe as seen in FIG. 3, has a generally trapezoidal cross-section such that its upper surface (that mates with upper 1) is narrower transverse to the major axis of the sole than is its lower surface (that mates with outsole 6). In other words, the heel area of the outsole is wider, transverse to the major axis of the sole, than the heel portion of the upper. In athletic shoes it is further typical to form the heel portion of the outer sole 6 integral with the forefoot portion of the sole with the combined portions constituting the shoe sole tread.

Figure 2:
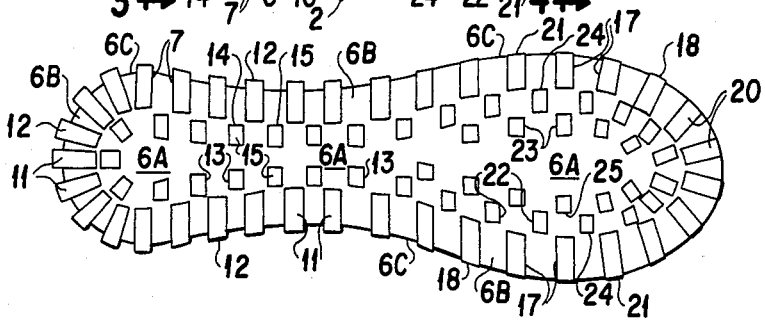
FIG. 2 is a bottom plan view of FIG. 1.

With attention first to the heel portion of the sole, approximately the left hand half of the sole as viewed in FIG. 2, said heel portion, as typically shown in FIG. 3, includes an outer series of resilient tread members, components or lugs 7 that extend integrally from peripheral portion 6B of the lower surface of outer sole 6, The peripheral portion 6B, from which extend the lugs 7, is relatively thick (when including lugs 7) compared to the central portion 6A which is relatively thin. Each tread member 7 has converging outwardly and downwardly inclined portions or walls (relative the sole major axis) at 10 and 11 terminating at a lower area which forms an apex, extremity or edge 12. Wall 11 constitutes a lug bottom wall or portion, while wall 10 constitutes a lug side wall or portion. Each of the discrete tread members may be seen to be of gradually reduced vertical section from the peripheral portion 6B toward the central portion 6A of outsole 6. An inner series of resilient components or lugs 13 may be provided offset from the sole edge 6C and staggered relative to the outer series of components and are each of lesser vertical dimension with each including downwardly inclined walls at 14 and 15 terminating at a lower extremity or edge 16. A plane at P1 contains lower edges 12 and 16 of the inner and outer lugs of FIG. 3 and intersects a second plane P2 common to the outer wall 10 of an outer lug 7 and an inclined side 5A of heel wedge 5. While the term "plane" is used in the foregoing description, it will be understood that wall surface 10 may be other than planar as may inclined walls 11 and 14, 15 of lugs 7 and 13. The intersection of P1 and P2 defines an acute included angle at x.

As seen in FIG. 3, the tread member 7 of this particular embodiment has a vertical section that approximates an obtuse triangle. The lower side portion 11 of the triangle extends from a first position on the lower surface of the outer sole 6 located inwardly of the outer edge 6C while the outer side portion 10 extends from a second position on the lower surface located closer to the outer edge 6C than the first position. The second position preferably although not necessarily approximately coincides with the outer edge 6C. The outer side portion 10 therefore makes an obtuse angle with that portion of the lower surface from which it extends. In this embodiment, again referring to FIGS. 3 and 5, the lower side portion 11 also makes an obtuse angle with the lower surface of the sole. It therefore may be appreciated that the tread members of this invention may be characterized in that they generally extend downwardly and outwardly at an obtuse angle to the lower surface of the sole for spreading outwardly upon impact with the ground (See FIG. 5) to dissipate the impact forces away from the foot and leg of the wearer.

The foot of the wearer is received within upper 1. and the area under the foot lies directly above the relatively thin central portion 6A of outsole 6. As seen in FIGS. 3 and 7, the peripheral tread members 7 and 30 extend laterally beyond the area directly below the foot, and the ground-contacting lower surfaces of the discrete peripheral tread members are located such that the wearer's weight will be concentrated laterally inwardly thereof.

Figure 4:
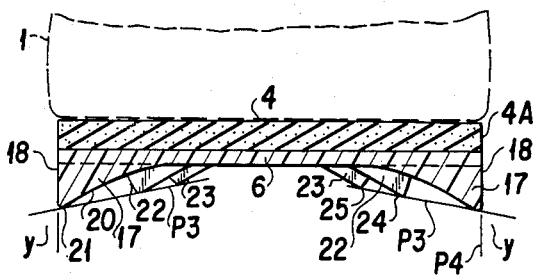

With attention now to FIG. 4, mid-sole 4 is shown suitably secured to the underside of upper 1 as by an adhesive and serves to receive the forefoot portion (the right hand half of FIG. 2) of outer sole 6. Outer sole 6 is provided with an outer row or series of tread components or lugs 17 each having an outer wall 18 and a bottom wall 20 converging at a lowermost extremity or edge 21. Inner rows or series of tread components or lugs are indicated at 22 and 23 with the lugs of each row having wall surfaces generally corresponding to those wall surfaces of outer lugs 17 but of a lesser vertical distance resulting in lugs 22–23 being of lesser overall height. Lugs 22 and 23 terminate downwardly in lowermost extremities 24 and 25 within a plane P3 which plane intersects a plane P4 containing outer lug wall 18, at an acute angle at y. While plane P4 is shown as being vertical, the same is preferably outwardly inclined from the side 4A of mid-sole 4.

Figure 5:
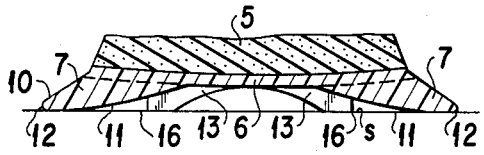
FIGS. 5 and 6 correspond to FIGS. 3 and 4 and show the sole heel and forefoot sole portions in ground contact.

Now with attention to FIG. 5, showing the heel portion of the present sole construction in foot biased contact with a ground surface S, the lugs 7 are shown displaced laterally outwardly and compressed from their unbiased position of FIG. 3. Subsequently, inner series of lugs 13 are also compressed under foot pressure deforming upon contact with the ground surface. Importantly, lower edges 12 initially contact the ground surface and flex to cushion initial ground contact with their compression and outward displacement contributing to the cushioning effect. Supplementing the action of lugs 7, and after displacement of same, inner lugs 13 also yield under heel pressure to provide a second stage of shock or impact absorption.

The ground engagement and lateral displacement of outer lugs 7 also contributes toward heel stability. Further, non-uniform displacement and compression of the sole lugs accommodates asymmetrical sole loading as occurs when the runner executes a change of direction. The reduced section side areas of resilient heel wedge 5 and mid-sole 4, being positioned above at least part of tread members 7, will also be, of course, subjected to some degree of compression during ground contact.

Figure 6:
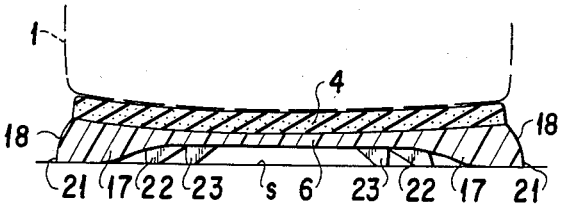

In a similar manner, outer lugs 17 of the forefoot portion of the sole are initially displaced upon contact with ground surface S per FIG. 6. Subsequent to initial displacement of outer lugs 17, the inner series of lugs 22 and 23 come into progressive (in a lateral direction) contact with the ground to provide supplementary or secondary cushioning to the forefoot beyond that already provided by the flexing of outer lugs 17.

Forefoot lugs 17, 22 and 23, in addition to cushioning against jarring impact, serve to provide a tread pattern highly adaptable to flexibly encompass rocks, projections and other small obstructions of the ground surface without significantly effecting foot-to-ground relationship or significantly diminishing tread traction. Further, the lugs provide excellent traction and permit independent degrees of lug flexing and compression, advantageous during execution of changes of direction by the wearer.

FIGS. 7, 8 and 9 show sectional views of modified sole constructions corresponding to the typical heel portion sectional view of FIG. 3 of the first described form of the invention. In FIG. 7, an outer sole is indicated at 26 affixed in a suitable manner to a heel wedge 27 with a mid-sole indicated at 28. The heel wedge has outwardly and downwardly sloped sides at 27A for greater resiliency. Outer sole components or lugs are indicated at 30 with laterally spaced series of inner lugs indicated at 31 and 32 each with vertical sidewalls. Lowermost extremities of the lugs 30A, 31A and 32A are within a plane P5 which intersects a plane P6 containing an inclined side of the heel to form a acute included angle w. It will be seen that the lugs 30–32 progressively cushion against ground impact much in the same manner as the first described sole by reason of outer lugs 30 initially contacting the ground with lugs 31 and 32 subsequently engaging and deforming upon surface contact. The lateral extremities of heel wedge 27, being of reduced section, will also compress and deform upwardly relative to the shoe upper to further cushion the foot.

In FIG. 8, an outer sole 25 is affixed to a mid-sole 36 on an upper 1. Note that mid-sole 36 of FIG. 8 has the same general cross-sectional shape as the outer sole 6 of FIG. 3. Mid-sole 36 has an upper surface 37, a lower surface 39, and outwardly and downwardly inclined sides 36A extending from the periphery of the upper surface 37 to the periphery of the lower surface 39. The lower surface 39 of the midsole 36 includes curved, concave portions which, together with the outer sole 35, form a general lateral concavity. Outer sole lugs are indicated at 38 with series of inner lugs at 40 and 41. The outer sole 35 includes a lower surface 47, a top surface 43, a central portion directly below the area where the foot is received in the upper, and a peripheral portion. The outer sole 35 is of substantially uniform thickness.

The top surface 43 of the outer sole 35 is connected to the concave lower surface 39 of the midsole 36 and conforms in shape thereto. Surfaces 43 and 39 together define a general lateral concavity for the shoe sole.

The lower surface 47 of the outer sole 35 is wider, measured transversely to the major axis of the sole, than the corresponding portion of the upper 1, such that the wearer's weight is concentrated inwardly of those portions of the tread members 38 which strike the ground first.

The tread members 38 integrally extend from the peripheral portion of the lower surface 47 of the outer sole 35 and cooperate with the peripheral portions of the concave midsole to support the central portions in a cantilever fashion. As discussed above with the embodiments of FIGS. 3–7, the tread members 38 include lower extremities that contact the ground and are urged upwardly and laterally outwardly with respect to the central portion upon foot impact with the ground. Tread members 38 include a lower wall 38A inclined at an obtuse angle to the central portion of outer sole 35, and an outer peripheral surface 38B which is vertical. A plane P7 contains the lowermost extremities or lugs 38 and 40 along one side of the sole. Plane P7 intersects a second plane 28 common to mid-sole side surface 36A and defines an acute included angle z. The cushioning actions of lugs 38, 40 and 41 of the heel portion shown in FIG. 8 are believed obvious in view of the foregoing description of the earlier described cushioning actions.

In FIG. 9, the mid-sole is dispensed with and an outer sole 42 is provided with inclined sidewalls as at 42A extending downwardly and outwardly from a shoe upper 1. The concave lowermost or tread surface 44 of the outer sole is shown without lugs. An arc shown as a line L1 defines the tread surface and intersects a second line L2 projected from outer sole sidewall 42A to define an acute included angle q. Accordingly, the lower side edge of outer sole 42 is of a sectional configuration as to be highly flexible to cushion impact loads.

In the forms of the invention viewed in FIGS. 7, 8 and 9 only the heel portion of the sole is illustrated. When applying the modified forms of the invention to the forefoot portion of the sole, it will be appreciated that the forefoot sole width will be somewhat greater as will be the transverse spacing of the lugs thereon as generally shown in FIG. 4.

In FIG. 10, I show the present invention applied to a conventional shoe or boot sole wherein a separate raised heel at 46 is provided with a row of outer lugs 47 and inner lugs 48 similar to the heel portion lugs 7 and 13 shown in FIG. 3. In continuing similarity to that form of the invention shown in FIGS. 3 through 6, the forefoot sole portion of the sole of FIG. 10 includes multiple rows of outer and inner lugs at 50 and 51 resepctively.

With attention now to FIGS. 11 and 12 wherein modified shoe sole construction is indicated generally at 2', parts of the modified shoe sole constructon corresponding to parts earlier described in the first form of the invention are identified with prime reference numerals. The sole 2' is of a shoe for the right foot.

The heel portion of the modified sole is approximately the left hand half of the outer sole 6' viewed in FIG. 11 and includes an outer series of resilient components or lugs 7' each having outwardly and downwardly inclined walls (relative the sole major axis A) at 10' and 11' terminating at a lowermost extremity 12'. As with the first embodiment, the downwardly and outwardly inclined resilient tread members or lugs generally form an obtuse angle with the lower surface of the outsole. An inner series of resilient components or lugs 13' may be provided offset from the sole edge and may be staggered relative to the outer series of lugs and are of lesser vertical dimension with each including downwardly inclined walls at 14' and 15' terminating at a lower extremity 16'. A plane P1' contains lower edges 12' and 16' of the inner and outer lugs and intersects a second plane P2' common to the outer wall 10' of an outer lug 7' and an inclined side 5A' of a heel wedge 5''at an acute included angle x'. A mid-sole at 4' also has downwardly and outwardly diverging sidewalls at 4A'. The heel wedge 5' and mid-sole 4' accordingly have side areas of reduced section which contribute to wedge and mid-sole compressibility.

With attention specifically to FIG. 12 the inside of the wearer's right foot will be associated with the left hand side of the Figure. Reinforcing means at 55 is shown as a web extending intermediate some of said outer lugs and serves to reinforce same against severe distortion during maximum loading. The web 55 extends about the curved heel portion of the shoe sole construction and forwardly along the inside edge thereof terminating forwardly approximately at the instep of the shoe. Left foot sole construction would be a mirror image of FIG. 11.

With attention to FIG. 12, it will be seen that the outer lugs 7' are not necessarily of uniform lateral dimension upon comparison of the two lugs illustrated having different lengths indicated respectively at D1 and D2. The length of the outer lug 7' is greater to provide additional support to the inside of the wearer's foot during heel impact with a ground surface and hence reduce the tendency of the ankle to pronate.

The shoe sole material may be a suitable synthetic such as polyurethane, which lends itself to low cost molding operations yet provides the desirable sole qualities of durability and flexibility. A somewhat more costly sole may be of rubber.

While I have shown but a few embodiments of the invention it will be apparent to those skilled in the art that the invention may be embodied still otherwise without departing from the spirit and scope of the invention encompassed within the scope of the appended claim terminology.

I claim:

1. A sole for an athletic shoe comprising:

shock absorbing means for cushioning the foot and leg of the wearer against impact loads and for dissipating impact forces laterally outwardly upon impact of the shoe with the ground, said shock absorbing means comprising:

a midsole having an upper surface, a concave lower surface, and peripheral and central portions, said upper surface adapted to be connected to an upper, said midsole having inclined side walls extending downwardly and outwardly from the periphery of said upper surface to the periphery of said concave lower surface;

an outer sole having peripheral and central portions and top and bottom surfaces, said outsole being of substantially uniform thickness and connected to said concave lower surface of said midsole to define a general lateral concavity for the sole;

said peripheral portions of said outer sole and said midsole cooperating to support said central portions of said outer sole and said midsole in a cantilever fashion; and a plurality of tread members disposed about said peripheral portion of said bottom surface of said outer sole, said tread members cooperating with said peripheral portions of said midsole to support said central portions in a cantilever fashion.

2. A sole as recited in claim 1, further comprising a plurality of lug components extending integrally from said bottom surface of said outer sole and being positioned inwardly of said tread members.

3. A sole as recited in claim 1, wherein said top surface of said outer sole and said lower surface of said midsole have a substantially similar shape.

4. A sole as set forth in claim 1, wherein said tread members include a lower wall inclined at an obtuse angle to said central portion of said outer sole.

5. A sole as set forth in claim 1, wherein said tread members are generally inclined downwardly and outwardly with respect to said central portion of said outer sole.

6. A sole as set forth in claim 1, wherein said discrete tread members include an outer peripheral surface which is vertical.

7. A sole as set forth in claim 2, wherein said tread members on said peripheral portion extend below said lug components.

8. A sole as set forth in claim 1, wherein said tread members include lower extremities that contact the ground and are urged resiliently upwardly and laterally outwardly with respect to said central portion upon foot impact with the ground.

9. A sole as set forth in claim 1, wherein said discrete tread members are spaced about the heel area of said outer sole.

10. A sole for an athletic shoe, comprising:

shock absorbing means for cushioning the foot and leg of the wearer against impact loads and for dissipating impact forces laterally outwardly upon impact of the shoe with the ground, said shock absorbing means comprising:

a midsole having an inner surface, a lower surface which includes a concave portion, and peripheral and central portions, said upper surface adapted to be connected to an upper;

an outer sole having peripheral and central portions and top and bottom surfaces, said outsole being of substantially uniform thickness and connected to said concave portions of said lower surface of said midsole to define a general lateral concavity for the sole;

said peripheral portions of said outer sole and said midsole cooperating to support said central portions of said outer sole and said midsole in a cantilever fashion; and a plurality of tread members disposed about said peripheral portion of said bottom surface of said outer sole, said tread members cooperating with said peripheral portions of said midsole to support said central portions in a cantilever fashion.

11. A sole as set forth in claim 10, wherein said tread members include a lower wall inclined at an obtuse angle to said central portion of said outer sole.

12. A sole as set forth in claim 10, wherein said tread members are generally inclined downwardly and outwardly with respect to said central portion of said outer sole.

13. A sole as set forth in claim 10, wherein said discrete tread members include an outer peripheral surface which is vertical.

14. A sole as set forth in claim 10, wherein said tread members include lower extremities that contact the ground and are urged resiliently upwardly and laterally outwardly with respect to said central portion upon foot impact with the ground.

15. A sole as set forth in claim 10, wherein said discrete tread members are spaced about the heel area of said outer sole.

* * * * *